US007611207B2

(12) United States Patent
Barfuss

(10) Patent No.: US 7,611,207 B2
(45) Date of Patent: Nov. 3, 2009

(54) SALON CHAIR HAVING MOVABLE FOOT REST

(76) Inventor: Linda Barfuss, 1746 Aspen La., Oak Harbor, WA (US) 98277

( * ) Notice: Subject to any disclaimer, the term of this patent is extended or adjusted under 35 U.S.C. 154(b) by 191 days.

(21) Appl. No.: 11/809,649

(22) Filed: Jun. 1, 2007

(65) Prior Publication Data

US 2008/0296956 A1 Dec. 4, 2008

(51) Int. Cl.
*A47C 7/50* (2006.01)
*A47C 20/00* (2006.01)
*A47C 20/04* (2006.01)

(52) U.S. Cl. ..... 297/423.2; 297/423.26; 297/423.28; 297/423.36

(58) Field of Classification Search ..... 297/432.2, 297/423.28, 423.36, 423.26
See application file for complete search history.

(56) References Cited

U.S. PATENT DOCUMENTS

| | | | | | |
|---|---|---|---|---|---|
| 9,960 | A | * | 8/1853 | Warren | 297/423.2 X |
| 128,459 | A | * | 7/1872 | Brennan | 297/423.2 |
| 156,004 | A | * | 10/1874 | Wayland | 297/423.36 X |
| 426,602 | A | * | 4/1890 | Muhl | 297/423.2 X |
| 464,670 | A | * | 12/1891 | Batt | 297/423.2 X |
| 516,110 | A | * | 3/1894 | Pynchon | 297/423.2 X |
| 556,343 | A | * | 3/1896 | Fleer et al. | 297/423.2 X |
| 2,151,729 | A | * | 3/1939 | Baker | 297/423.2 X |
| 2,664,944 | A | * | 1/1954 | Lundquist | 297/423.28 X |
| 3,087,757 | A | * | 4/1963 | Fidel | 297/423.28 |
| 4,358,156 | A | | 11/1982 | Sharff | |
| 4,852,941 | A | * | 8/1989 | Jones | 297/423.36 X |
| 4,995,670 | A | | 2/1991 | Rodas | |
| 5,039,167 | A | | 8/1991 | Sweet | |
| 5,374,102 | A | | 12/1994 | Archambault et al. | |
| 5,494,334 | A | | 2/1996 | Zvonik | |
| 5,507,562 | A | * | 4/1996 | Wieland | 297/423.2 |
| 5,651,587 | A | * | 7/1997 | Kodaverdian | 297/423.36 |
| 5,755,493 | A | * | 5/1998 | Kodaverdian | 297/423.36 |
| 5,782,535 | A | * | 7/1998 | Lafer | 297/423.36 |
| 5,882,083 | A | * | 3/1999 | Robinson | 297/423.2 X |
| 5,887,949 | A | * | 3/1999 | Kodaverdian | 297/423.36 |
| 6,030,033 | A | * | 2/2000 | Schultz | 297/423.36 X |
| 6,036,268 | A | | 3/2000 | Larson | |
| D424,819 | S | | 5/2000 | Galati, Jr. et al. | |
| 6,076,893 | A | | 6/2000 | Brotherston | |
| D434,916 | S | | 12/2000 | Galati, Jr. et al. | |
| 6,155,645 | A | * | 12/2000 | Bedrich | 297/423.28 |
| 6,196,631 | B1 | | 3/2001 | Larson | |
| 6,382,727 | B1 | * | 5/2002 | Pickard | 297/423.36 |
| 6,446,287 | B2 | | 9/2002 | Borders | |
| 6,517,160 | B2 | * | 2/2003 | Marcantoni | 297/423.36 |
| 6,517,162 | B2 | | 2/2003 | Cheng | |
| 6,533,360 | B1 | * | 3/2003 | Parkel et al. | 297/423.28 |

(Continued)

*Primary Examiner*—Rodney B White
(74) *Attorney, Agent, or Firm*—Charles J. Rupnick

(57) ABSTRACT

A novel salon chair having a novel movable footrest assembly with a sliding or pivoting footrest which replaces a conventional rigid tubular one-piece footrest typical of salon chairs. The salon chair includes a chair portion structured for being elevated above a floor surface, the chair portion having a seat portion elevated on a support portion and a seat back portion. A footrest portion has a foot support portion that is movable between an extended configuration relative to the seat portion of the chair portion, and a retracted configuration relative thereto. An actuator mechanism coupled between the chair portion and the footrest portion is structured for moving the foot support portion between the extended and retracted configurations.

10 Claims, 4 Drawing Sheets

U.S. PATENT DOCUMENTS 6,652,033 B2 * 11/2003 Satoh ..... 297/423.36 X
6,659,562 B2 * 12/2003 Uchiyama ..... 297/423.36 X
6,663,184 B2 * 12/2003 Hagiike ..... 297/423.36 X
6,692,068 B1 * 2/2004 Tang ..... 297/423.26 X
6,692,078 B2 * 2/2004 Pham et al. ..... 297/423.2
6,739,662 B1 5/2004 Alvarez
6,752,463 B2 * 6/2004 Nivet ..... 297/423.36 X
6,764,137 B2 * 7/2004 Menard ..... 297/423.36
D502,330 S 3/2005 Petruccelli
6,866,341 B2 3/2005 Behnert
6,874,855 B2 * 4/2005 Nivet ..... 297/423.36 X
7,052,082 B1 5/2006 Thomas
2008/0217982 A1 * 9/2008 Parkel et al. ..... 297/423.28

* cited by examiner

SALON CHAIR HAVING MOVABLE FOOT REST

FIELD OF THE INVENTION

The present invention relates generally to salon or styling chairs, and in particular to salon or styling chairs having movable footrest assemblies.

BACKGROUND OF THE INVENTION

Salon chairs are widely used by beauticians and other individuals performing hairdressing or other service for a patron seated in such chairs. As taught by Zvonik in U.S. Pat. No. 5,494,334, which is incorporated in its entirety herein by reference, salon or styling chairs having stationary footrest assemblies are generally well-known. A typical salon chair having a rigid tubular U-shaped footrest is depicted by Rodas in U.S. Pat. No. 4,995,670, which is incorporated in its entirety herein by reference. Rodas additionally teaches a circular hairdresser footrest which is connectable around the base of the salon chair for supporting the hairdresser's foot while working on a customer seated in a salon chair.

However, as taught by Zvonik, the patron may have difficulty taking a seated position in these prior art salon chairs. The user must either step over the horizontal foot-engaging and supporting portion of the rigid U-shaped footrest, or stand in front of the salon chair with the backs of the ankles against the horizontal foot engaging portion and then literally fall backward into the chair. Users with ambulatory problems, particularly the elderly or infirm, have a great deal of difficulty both getting into and out of these chairs because of the rigid immovable nature of these conventional footrests.

Furthermore, in dealings with the elderly and infirm, for example in an assisted living arena, the salon chair is experienced not only by the patron entering and leaving the chair. The salon chair is often also experienced by one or more caregivers and the operator. Caregivers experience the salon chair while assisting the patron into and out of the chair; caregivers may even have to lift the patron between a wheel chair and the salon chair. The operator experiences the salon chair while grooming or otherwise servicing the patron.

Zvonik and others have provided various apparatus intended to overcome this seating challenge. However, known footrest assemblies for salon chairs are limited in their ability to provide a comfortable movable footrest assembly that operates simply, efficiently and safely. Unfortunately, the footrest assembly taught by Zvonik, as well as other known footrest assemblies for salon chairs, consistently leaves at least a portion of the footrest or footrest support extended in front of the chair, even when the actual footrest is moved into a non-use position. These extended portions of the footrest assembly present a danger to the caregiver and operator alike, who may become entangled in them or even trip over them, hurting themselves and endangering others, including the elderly or infirm patron.

SUMMARY OF THE INVENTION

The present invention is a novel salon chair having a novel movable footrest assembly with a sliding or pivoting footrest which replaces a conventional rigid tubular one-piece footrest typical of salon chairs.

According to one aspect of the novel salon chair, the salon chair includes a chair portion structured for being elevated above a floor surface, the chair portion having a seat portion elevated on a support portion and a seat back portion. A footrest portion has a foot support portion that is movable between an extended configuration relative to the seat portion of the chair portion, and a retracted configuration relative thereto. An actuator mechanism coupled between the chair portion and the footrest portion is structured for moving the foot support portion between the extended and retracted configurations.

According to another aspect of the novel salon chair, the salon chair further includes a guide mechanism fixed between the chair portion and the footrest portion, the guide mechanism being structured for guiding the footrest portion between the extended and retracted configurations.

According to another aspect of the novel salon chair, the guide mechanism further includes one or more guides fixed relative to either the support portion of the chair portion or an underside surface of the seat portion thereof.

According to another aspect of the novel salon chair, the actuator mechanism further includes a linkage mechanism coupled between the chair portion and the footrest portion.

According to another aspect of the novel salon chair, the footrest portion further includes a leg portion angularly extended away from the seat portion and terminating in the foot support portion distal from the seat portion. The guide mechanism further includes a translational guide mechanism structured for translating the leg and foot support portions relative to the chair portion.

According to another aspect of the novel salon chair, the footrest portion further includes a sled portion angularly extended from the leg portion adjacent to the underside of the seat portion of the chair portion. The translational guide mechanism further includes a track extended adjacent to the underside of the seat portion of the chair portion, translational guide mechanism being structured to receive the sled portion of the footrest portion in a translational manner. According to another aspect of the novel salon chair, the sled portion of the footrest portion is further received by the track portion of the translational guide mechanism in a sliding manner.

According to another aspect of the novel salon chair, the footrest portion is further formed with a knee portion adjacent to the seat portion; and the guide mechanism further includes a pivotal guide mechanism interfaced between the knee portion and the chair portion, the pivotal guide mechanism being structured for pivoting the footrest portion relative to the chair portion.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

Figure 1:
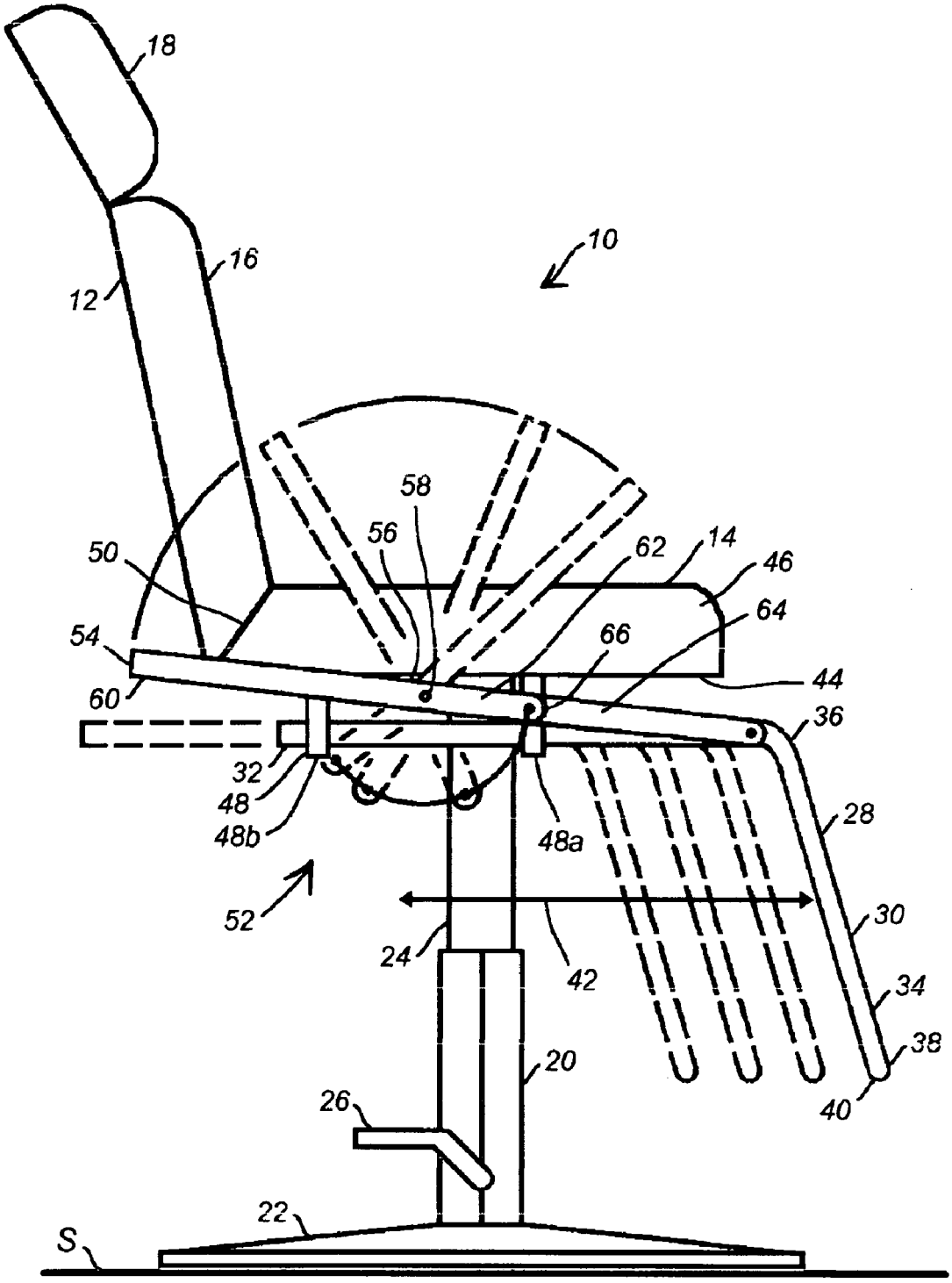
FIG. 1 illustrates an example of a salon chair having the novel movable footrest assembly.

FIG. 1 illustrates an example of a novel salon chair 10 having a salon chair portion 12 including a substantially horizontal seat 14 from which depends seat back 16 which may be reclinable in a multipurpose chair or fixed substantially upright in a conventional styling chair. A head rest 18 is optional. The salon chair 10 is expected to be supported on a pedestal 20 having for example a circular base 22 that engages a horizontal floor surface S and a post 24 that supports the salon chair portion 12. The support post 24 is optionally included as part of a seat elevation adjustment mechanism 26 for adjustably positioning the seat with the patron at a convenient elevation for the hairdresser or other service provider. If present, the elevation adjustment mechanism 26 is, by example and without limitation, a mechanical or pneumatic drive mechanism of a conventional type that is generally well-known for use with conventional salon chairs, or another such mechanism 26.

The novel salon chair 10 further includes a novel movable footrest assembly 28 illustrated here in a fully deployed position for supporting the patron's feet. The novel footrest assembly 28 includes a substantially rigid tubular footrest portion 30 for supporting the patron's feet. The footrest portion 30 includes a sled portion 32 extended under the horizontal chair seat 14 and a generally U-shaped or C-shaped leg portion 34 extended at a knee portion 36 and angularly canted away from the chair seat 14 and toward the floor S. The leg portion 34 thus accommodates the patron's feet below and in front of the salon chair 10. The leg portion 34 terminates at a free end 38 in a foot support portion 40, more clearly illustrated in FIGS. 2 and 3, which is elevated above the floor surface S to aid the patron in mounting the chair portion 12.

The sled portion 32 is structured to follow a course 42 that substantially follows along an under surface 44 of the chair seat 14 and leads the leg portion 34 between a position adjacent to or extended beyond a front portion 46 of the chair seat 14 and a position retracted under the chair seat 14, for example near to the chair pedestal 20. By example and without limitation, the course 42 is embodied by one or more tracks or guide ways 48 provided in a position substantially under the salon chair portion 12 and substantially immobile or fixed relative to the chair seat 14 or the chair pedestal 20. The sled portion 32 is structured to move along the one or more tracks or guide ways 48 to follow the course 42 under the chair seat 14. For example, the sled portion 32 is structured to be received by the tracks or guide ways 48 and to slide along them. The sled portion 32 either fits inside the tracks or guide ways 48 or wraps around outside them. Stiction is avoided or eliminated using appropriate bushings between the sled portion 32 and the tracks or guide ways 48. Alternatively, the sled portion 32 is structured to roll along the tracks or guide ways 48 on rollers such as ball bearings, or on wheels. By example and without limitation, the tracks or guide ways 48 are connected or otherwise provided adjacent to the under surface 44 of the chair seat 14. Optionally, the tracks or guide ways 48 are provided on the chair pedestal 20, for example on the support post 24 adjacent to the under surface 44 of the chair seat 14. As illustrated, two substantially parallel tracks or guide ways 48 are connected to the chair seat under surface 44 and projected from a portion thereof. Here, the tracks or guide ways 48 are illustrated as being spaced apart on opposite sides of the support post 24 portion of the chair pedestal 20. Furthermore, by example and without limitation the tracks or guide ways 48 are optionally formed by two sets of guide ways 48*a* and 48*b* on the chair seat under surface 44 at spaced apart positions forward of the chair pedestal 20 toward the front portion 46 of the chair seat, and aft of the chair pedestal 20 adjacent to a rear portion 50 of the chair seat 14. This optional configuration of the tracks or guide ways 48 effectively ensures the sled portion 32 follows the course 42 smoothly without excessive binding or sticking. Motion of the sled portion 32 of the footrest portion 30 effectively translates the leg portion 34 and foot support portion 40 at its free end 38 between the extended position adjacent to or in front of the front portion 46 of the chair seat 14 for use by the patron mounting the chair portion 12, and the retracted position under the chair seat 14 where it is out of the patron's way when stepping out of the chair portion 12.

By example and without limitation, the novel footrest assembly 28 is actuated by means of a novel linkage mechanism 52 coupled to the footrest portion 30. However, other means for actuating the footrest assembly 28 for moving the footrest portion 30 between the extended and retracted positions of the leg portion 34 and foot support portion 40 are also contemplated and may be included without deviating from the scope and intent of the present invention. For example, the novel footrest assembly 28 is alternatively actuated by means of a crank or an electric motor operating a conventional chain or screw drive, or a hydraulic or pneumatic cylinder pulling and pushing the footrest portion 30 either directly or through a linkage mechanism.

The linkage mechanism 52 as illustrated here by example and without limitation includes a substantially rigid lever arm 54 having a rotation portion 56 pivotable about a fulcrum mechanism 58, such as a pin (FIGS. 1, 2, 3) or rod (FIGS. 4, 5), that is fixed in a substantially stationary position relative to the chair seat under surface 44. A longer control arm portion 60 of the lever arm 54 extends from the rotation portion 56 into a range reachable by an operator of the salon chair 10; for example, the control arm portion 60 extends generally above the chair seat 14, as illustrated. However, the control arm portion 60 could just as easily optionally extend into a range nearer the floor surface S, and thereby avoid interference with the operator. The lever arm 54 includes a second shorter drive arm portion 62 extended from the rotation portion 56 into a range adjacent to the movable footrest assembly 28. A substantially rigid drive rod 64 is pivotably coupled between an end 66 of the drive arm portion 62 of the lever arm 54 distal from the rotation portion 56 and the footrest portion 30. By example and without limitation, the drive rod 64 is pivotably coupled to the footrest portion 30 near the knee portion 36 between the sled portion 32 and the leg portion 34.

FIG. 1 also illustrates operation of the novel salon chair 10. Well-known mechanics cause the footrest portion 30 to move along the course 42 when the linkage mechanism 52 is operated. For example, as illustrated by phantom lines, manual rotation of the longer control arm portion 60 of the lever arm 54 about the fulcrum mechanism 58 simultaneously rotates the shorter drive arm portion 62 attached to the rotation portion 56. The drive arm portion 62 pushes or pulls the footrest portion 30 through the interconnecting drive rod 64, and the footrest portion 30 moves along the course 42 between the extended and retracted positions, as illustrated by the phantom lines.

Figure 2:
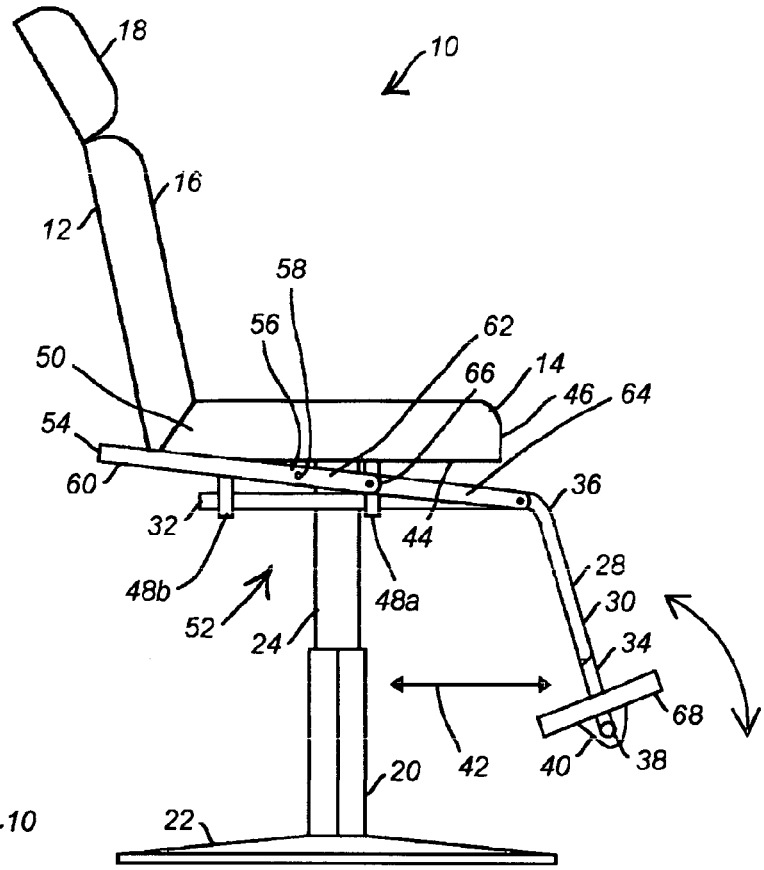
FIG. 2 illustrates by example and without limitation an extended position of a novel linkage mechanism and interconnected footrest portion of the novel movable footrest assembly.
Figure 3:
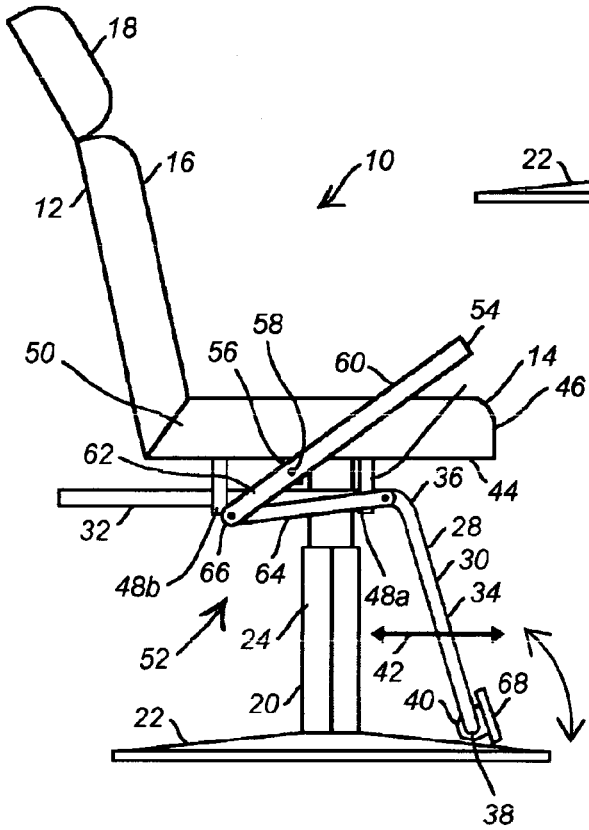
FIG. 3 illustrates by example and without limitation a retracted position of a novel linkage mechanism and interconnected footrest portion of the novel movable footrest assembly.

FIGS. 2 and 3 illustrate the extended and retracted positions, respectively, of the linkage mechanism 52 and interconnected footrest portion 30 of the novel movable footrest assembly 28. Furthermore, the foot support portion 40 is illustrated as a foot plate support 68 that is either fixed to the leg portion 34, else pivoted (arrows) there about either by foot or by hand from an in-use substantially horizontal position (FIG. 2) to a deflected out-of-the-way or non-use position against the canted leg portion 34 (FIG. 3). By this arrangement, the elderly and ambulatory-impaired users may easily step up the salon chair portion 12 for seating when the foot plate support 68 is in the deflected non-use position and then they, themselves or an assistant may then pivot the foot plate support 68 downwardly into the substantially horizontal in-use position.

Figure 4:
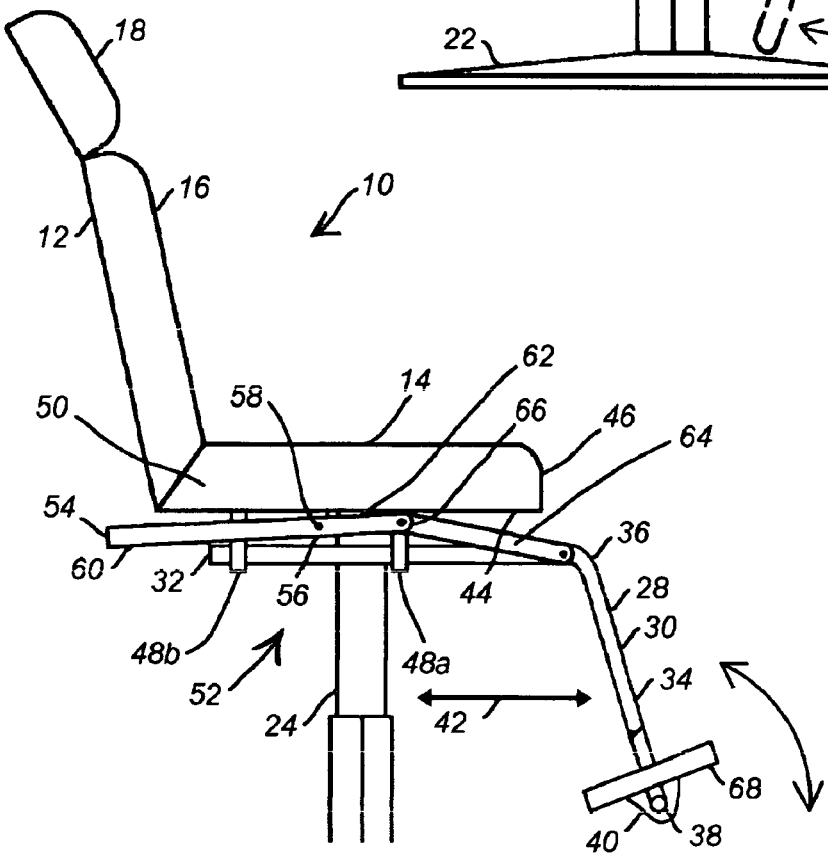
FIG. 4 illustrates by example and without limitation one footrest locking mechanism operable in the extended position of the movable footrest assembly.

FIG. 4 illustrates one footrest locking mechanism operable in the extended position of the movable footrest assembly 28. By example and without limitation, the linkage mechanism 52 is in an over-center locking configuration, whereby the footrest portion 30 cannot be accidentally retracted. Other footrest locking mechanisms are also contemplated and may be included without deviating from the scope and intent of the present invention. For example, pins or friction mechanisms can be used to retain the footrest portion 30 against unintentional retraction.

Figure 5:
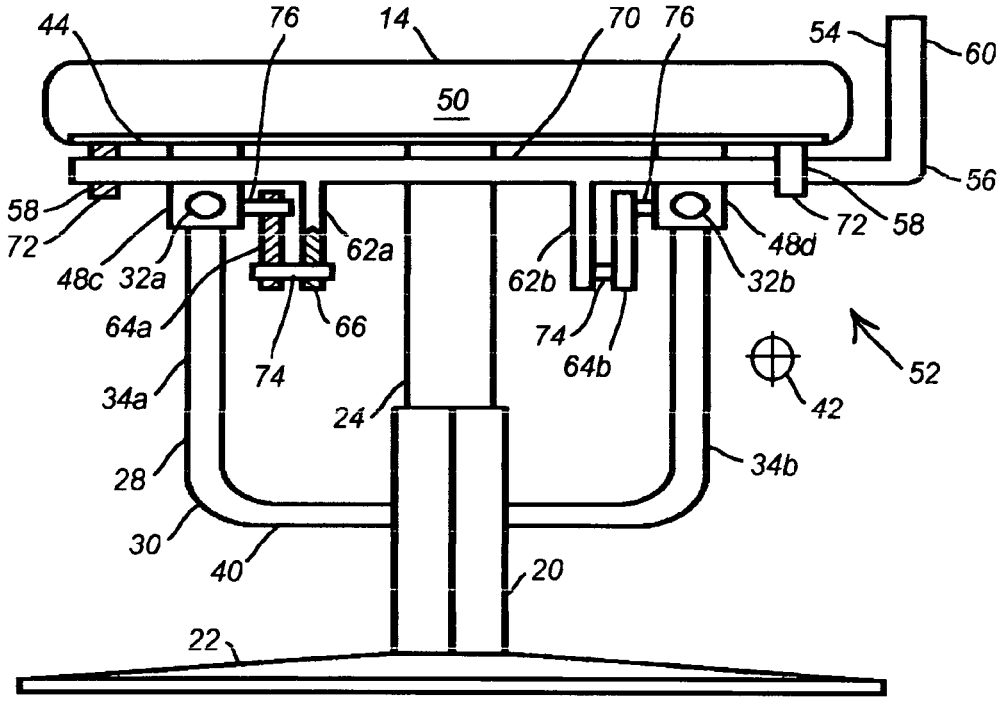
FIG. 5 is a rear view of one exemplary embodiment of the novel salon chair wherein the seat back and optional head rest are removed from the seat portion of the salon chair portion for clarity.
Figure 6:
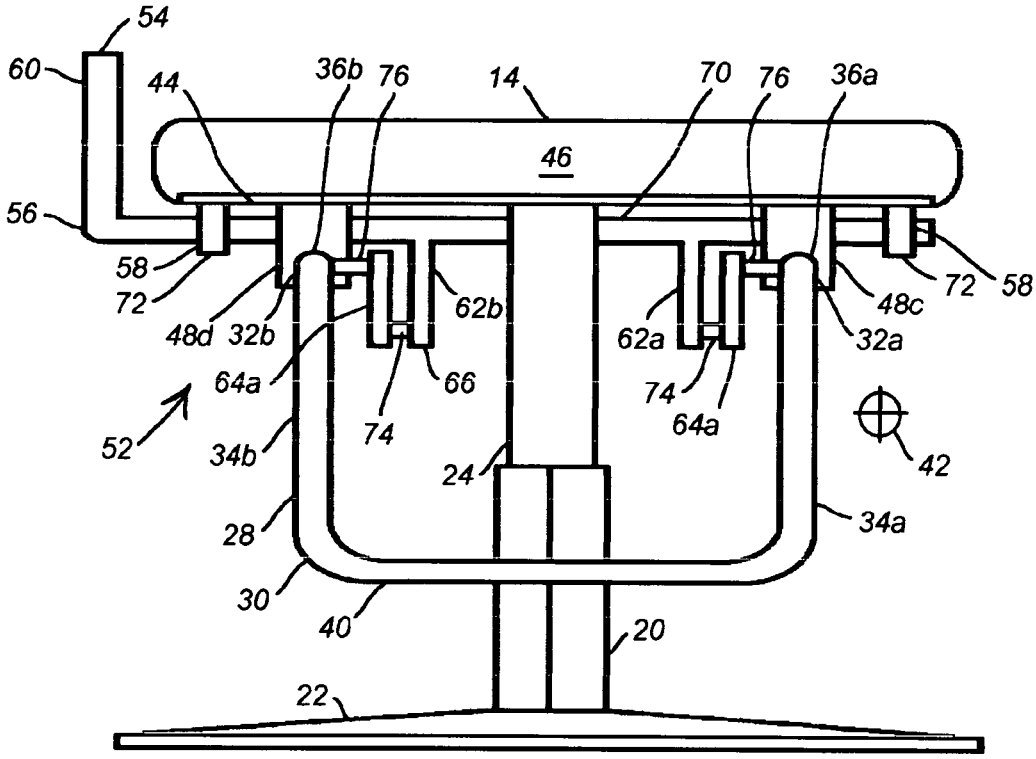
FIG. 6 is a front view of one exemplary embodiment of the novel salon chair wherein the seat back and optional head rest are removed from the seat portion of the salon chair portion for clarity.

FIGS. 5 and 6 are rear and front views, respectively, of one embodiment of the novel salon chair 10 wherein the seat back 16 and optional head rest 18 are removed from the seat portion 14 of the salon chair portion 12. The tracks or guide ways 48 are illustrated here by example and without limitation as the two sets of guide ways 48*a* and 48*b* on the chair seat under surface 44 at spaced apart positions forward (FIG. 6) of the chair pedestal 20 toward the front portion 46 of the chair seat, and aft (FIG. 5) of the chair pedestal 20 adjacent to the rear portion 50 of the chair seat 14. As discussed herein, this optional configuration of the tracks or guide ways 48 effectively ensures the sled portion 32 follows the course 42 smoothly without excessive binding or sticking while translating the leg portion 34 of the footrest portion 30 between the extended and retracted positions. Furthermore, as illustrated here by example and without limitation, the two sets of guide ways 48*a* and 48*b* are further structured as two sets of two sets of guide ways 48*c* and 48*d* on the left and right of the pedestal 20. The sled portion 32 is structured as a pair of spaced-apart sleds 32*a* and 32*b* each slidably mounted both the front and aft guide ways 48*a*, 48*b* in one of the two sets of left and right guide ways 48*c* and 48*d*. Thus, the pair of sleds 32*a*, 32*b* follow the course 42 substantially along the under surface 44 of the chair seat 14. The leg portion further includes a pair of leg portions 34*a* and 34*b* each extended at knee portion 36*a* and 36*b* from the sled portions 32*a*, 32*b*, respectively. The leg portions 34*a*, 34*b* each terminate at respective free ends 38*a* and 38*b* with the foot support portion 40 extended between them.

Here, the fulcrum mechanism 58 of the linkage mechanism 52 is illustrated by example and without limitation being configured as a rod 70 that is rotatable in a pair of blocks 72 spaced on either side of the chair seat portion 14 and fixed to the chair seat under surface 44. Appropriate bushings are optionally inserted between the rod 70 and blocks 72 to ensure smooth rotation. The longer control arm portion 60 of the lever arm 54 optionally extends rigidly from the rotation portion 56 adjacent to one end of the rod 70, and is optionally an extension of the rod 70 portion of the fulcrum mechanism 58. The second shorter drive arm portion 62 of the lever arm 54 is optionally rigidly extended from the rotation portion 56 as a pair of spaced-apart drive arm portions 62*a* and 62*b* adjacent to respective spaced-apart sled portions 32*a*, 32*b*. The drive rod 64 is structured as a pair of drive rods 64*a* and 64*b* pivotably coupled between the respective drive arm portions 62*a*, 62*b* of the lever arm 54 and the footrest portion 30 by pins 74. By example and without limitation, pins 76 couple the drive rods 64*a*, 64*b* to the respective leg portions 34*a*, 34*b* of the footrest portion 30 adjacent to the respective knee portions 36*a*, 36*b*. However, the drive rods 64*a*, 64*b* are optionally coupled to the footrest portion 30 elsewhere than the knee portions 36*a*, 36*b* without deviating from the scope and intent of the present invention. For example, the drive rods 64*a*, 64*b* are optionally coupled to the respective leg portions 34*a*, 34*b* of the footrest portion 30 between the respective knee portions 36*a*, 36*b* and the free ends 38*a*, 38*b* without deviating from the scope and intent of the present invention. Else, the drive rods 64*a*, 64*b* are optionally coupled to the respective sled portions 32*a*, 32*b* between the two sets of guide ways 48*a* and 48*b* also without deviating from the scope and intent of the present invention. The moving parts of the linkage mechanism 52 is thus primarily hidden under the chair seat 14 so it is out of the way and does not endanger the patron nor caregiver nor operator. In a practical application of the novel linkage mechanism 52, the lever arm 54 is discretely proportioned and effectively protected to avoid accidental interference with either a caregiver assisting the patron or the operator during performance of service.

Figure 7:
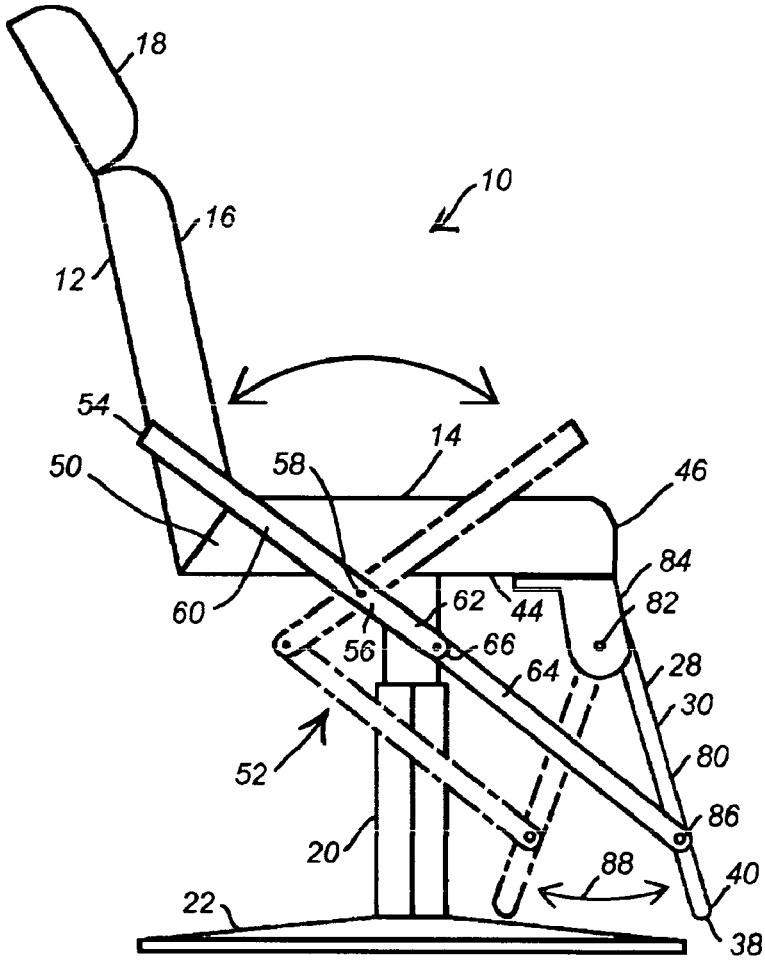
FIG. 7 illustrates by example and without limitation another embodiment of the novel salon chair wherein the novel movable footrest assembly is operable in a pivoting configuration rather than the translating configuration illustrated in previous Figures.

FIG. 7 illustrates another embodiment of the novel salon chair 10 wherein the novel movable footrest assembly 28 is operable in a pivoting configuration rather than the translating configuration illustrated in previous Figures. By example and without limitation, the novel movable footrest assembly 28 includes a pivotable footrest portion 78 having a generally U-shaped or C-shaped leg portion 80 pivotably suspended by one or more pins 82 from a substantially stationary bracket 84 fixed relative to the chair seat 14, for example, connected to either the chair seat under surface 44, or the chair pedestal 20.

The linkage mechanism 52 includes the substantially rigid lever arm 54 having the rotation portion 56 pivotable about the fulcrum mechanism 58. The lever arm 54 includes the longer control arm portion 60 and the second shorter drive arm portion 62 extended from the rotation portion 56. The substantially rigid drive rod 64 is pivotably coupled between the distal end 66 of the drive arm portion 62 and the pivotable footrest portion 78 of the novel movable footrest assembly 28. By example and without limitation, the drive rod 64 is pivotably coupled to the leg portion 80 by one or more pins 86.

The position for the one or more pins 86 coupling the drive rod 64 to the leg portion 80 is selected such that the leg portion 80 of the pivotable footrest portion 78 is structured to swing in a arcing course 88 between a position adjacent to or extended beyond the front portion 46 of the chair seat 14 and a position retracted under the chair seat 14, for example near to the chair pedestal 20.

Furthermore, by example and without limitation, the linkage mechanism 52 is illustrated here in a slightly over-center locking configuration, whereby the pivotable footrest portion 78 cannot be accidentally retracted. Other footrest locking mechanisms are also contemplated and may be included without deviating from the scope and intent of the present invention. For example, pins or friction mechanisms can be used to retain the pivotable footrest portion 78 against unintentional retraction.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A salon chair, comprising:

a chair portion structured for being elevated above a floor surface, the chair portion having a seat portion elevated on a support portion and a seat back portion;

a footrest portion comprising a foot support portion movable between an extended configuration relative to the seat portion of the chair portion, and a retracted configuration relative thereto, wherein the footrest portion further comprises a leg portion angularly extended away from the seat portion and terminating in the foot support portion distal from the seat portion, and a sled portion extended from the leg portion adjacent to the underside of the seat portion of the chair portion; and a translational guide mechanism fixed between the chair portion and the footrest portion and being structured for translating the leg and foot support portions of the footrest portion relative to the chair portion between the extended and retracted configurations, wherein the translational guide mechanism further comprises a track fixed relative to one of the support portion of the chair portion and an underside surface of the seat portion thereof and extended adjacent to the underside of the seat portion of the chair portion and structured to receive the sled portion of the footrest portion in a translational manner; and an actuator mechanism coupled between the chair portion and the footrest portion and being structured for moving the foot support portion between the extended and retracted configurations, wherein the actuator mechanism further comprises a linkage mechanism coupled between the chair portion and the footrest portion.

2. The salon chair of claim 1 wherein the sled portion of the footrest portion is further received by the track portion of the translational guide mechanism in a sliding manner.

3. A salon chair, comprising:

a chair portion structured for being elevated above a floor surface, the chair portion comprising a seat portion elevated on a support portion and a seat back portion;

a footrest portion comprising a knee portion adjacent to the seat portion of the chair portion and a foot support portion movable between an extended configuration relative to the seat portion, and a retracted configuration relative thereto;

a guide mechanism fixed between the chair portion and the footrest portion and being structured for guiding the footrest portion between the extended and retracted configurations, the guide mechanism comprising one or more guides fixed relative to one of the support portion of the chair portion and an underside surface of the seat portion thereof, and a pivotal guide mechanism between the knee portion and the chair portion, the pivotal guide mechanism being structured for pivoting the footrest portion relative to the chair portion; and an actuator mechanism comprising a linkage mechanism coupled between the chair portion and the footrest portion, the actuator mechanism being structured for moving the foot support portion between the extended and retracted configurations.

4. The salon chair of claim 3 wherein the footrest portion further comprises a leg portion angularly extended away from the seat portion and terminating in the foot support portion distal from the seat portion; and the guide mechanism further comprises a translational guide mechanism structured for translating the leg and foot support portions relative to the chair portion.

5. A salon chair, comprising:

a chair portion structured for being elevated above a floor surface, the chair portion having a seat portion elevated on a support portion and a seat back portion;

a footrest portion comprising a leg portion angularly extended away from the seat portion and terminating in a foot support portion and a sled portion extended from the leg portion adjacent to the underside of the seat portion of the chair portion;

means for actuating the footrest portion between a deployed relationship with the chair portion having the leg portion extended relative to the seat portion of the chair, and a retracted relationship having the leg portion retracted relative to the seat portion, wherein the means for actuating the footrest portion further comprises a linkage mechanism coupled between the chair portion and the footrest portion; and means for translating the leg and foot support portions of the footrest portion relative to the chair portion between the deployed relationship and the retracted relationship, the means for translating the leg and foot support portions of the footrest portion comprising a track fixed relative to one of the support portion of the chair portion and an underside surface of the seat portion thereof and extended adjacent to the underside of the seat portion thereof and structured to receive the sled portion of the footrest portion for translating there along.

6. The salon chair of claim 5, further comprising means for immobilizing the footrest portion in the deployed relationship with the chair portion.

7. The salon chair of claim 5 wherein the means for guiding the footrest portion further comprises means for pivoting the leg and foot support portions relative to the chair portion.

8. A salon chair, comprising:

a chair portion structured for being elevated above a floor surface, the chair portion comprising a seat portion elevated on a support portion and a seat back portion;

a guide fixed relative to an underside of the seat portion of the chair between opposing front and rear portions of the seat portion, the guide comprising a track fixed relative to one of the support portion and an underside of the seat portion of the chair and substantially aligned between the opposing front and rear portions of the seat portion; and a footrest portion having an interface portion comprising an elongate sled portion translationally engaged with the track of the guide, and a leg portion extended from the interface portion at an angle away from the seat portion and terminating in a foot support portion; and a linkage mechanism coupled between the chair portion and the footrest portion and being structured for moving the leg and foot support portions of the footrest portion between a deployed relationship with the chair portion having the leg and foot support portions extended relative to the seat portion of the chair, and a retracted relationship having the leg and foot support portions retracted relative to the seat portion.

9. A salon chair, comprising:

a chair portion structured for being elevated above a floor surface, the chair portion having a seat portion elevated on a support portion and a seat back portion;

a guide fixed relative to an underside of the seat portion of the chair between opposing front and rear portions of the seat portion, the guide comprising a plurality of spaced apart tracks each fixed relative to one of the support portion and an underside of the seat portion of the chair and substantially aligned between the opposing front and rear portions of the seat portion;

a footrest portion having an interface portion comprising a plurality of elongate sled portions each slidingly engaged with a corresponding one of the plurality of spaced apart tracks of the guide in a translational manner, and a leg portion extended from the interface portion at an angle away from the seat portion and terminating in a foot support portion; and a linkage mechanism coupled between the chair portion and the footrest portion and being structured for moving the leg and foot support portions of the footrest portion between a deployed relationship with the chair portion having the leg and foot support portions extended relative to the seat portion of the chair, and a retracted relationship having the leg and foot support portions retracted relative to the seat portion.

10. The salon chair of claim 9 wherein the guide further comprises a bracket coupled to an underside of the seat portion adjacent to the front portion thereof;

the interface portion of the footrest portion further comprises a knee portion pivotably coupled to the bracket; and a pivot engaged between the bracket and the knee portion of the footrest portion.

* * * * *